United States Patent [19]

Heinrich

[11] 4,294,184

[45] Oct. 13, 1981

[54] MULTI-HULL STEERING SYSTEM

[76] Inventor: Bernd Heinrich, Flat 27, 40 Spofforth St., Cremorne, N.S.W., Australia, 2090

[21] Appl. No.: 27,821

[22] Filed: Apr. 6, 1979

[30] Foreign Application Priority Data

Apr. 11, 1978 [AU] Australia ..... PD3976

[51] Int. Cl.[3] ..... B63B 1/00

[52] U.S. Cl. ..... 114/61; 114/39; 114/123; 114/43; 114/144 R; 9/2 A

[58] Field of Search ..... 114/43, 61, 39, 123, 114/65 R, 144 R; 9/2 A

[56] References Cited

U.S. PATENT DOCUMENTS

| | | | |
|---|---|---|---|
| 2,162,134 | 6/1939 | Squier | 114/61 |
| 2,351,542 | 6/1944 | Paull | 114/43 |
| 3,172,134 | 3/1965 | Livingstone | 114/61 |
| 3,395,664 | 8/1968 | Greenberg | 114/43 |
| 3,593,684 | 7/1971 | Cogliano | 114/61 |
| 3,846,858 | 11/1974 | Syfritt | 114/61 |
| 3,870,004 | 3/1975 | Bailey | 114/43 |

FOREIGN PATENT DOCUMENTS

| | | | |
|---|---|---|---|
| 2649557 | 5/1978 | Fed. Rep. of Germany | 114/61 |

*Primary Examiner*—Trygve M. Blix
*Assistant Examiner*—D. W. Keen
*Attorney, Agent, or Firm*—Stevens, Davis, Miller & Mosher

[57] ABSTRACT

A multi-hull craft steering system having a plurality of hulls made from flexible envelopes inflated to maintain buoyancy. One of the hulls is located between the remaining hulls and is pivotally mounted for controlling the angular variation in azimuth. The hull is located ahead of the remaining hulls to permit rotation without interference. The hulls have a variable track wherein the distance between the outer hulls may be selected and locked. The craft is provided with a means for angularly rotating the outer hulls with respect to the longitudinal axis of the craft to permit first working position and a second stowed position.

6 Claims, 18 Drawing Figures

MULTI-HULL STEERING SYSTEM

This invention relates to multi-hull boats, and more particularly to an improved steering system for such boats.

It is known to use various multi-hull craft such as catamarans and trimarans, but these have usually been provided with hulls constructed from rigid materials, similar to those employed for building conventional yachts, skiffs, racing shells and the like, depending upon the relative, and sometimes conflicting, requirements of stability and speed potential.

It is an object of the present invention to provide a multi-hull marine craft which combines, to a high degree, the above-mentioned desirable properties, more especially in a craft which is readily convertible so as to adapt it for use either for floatation in water or as a land yacht.

It is a further object of the invention to enable a multi-hull craft to be steered easily by the application of small forces, without the necessity for power boosting, more especially in the case of sail boats, on board which it may be desirable to carry no engine-drive appliances whatever. In this connection, it will be appreciated that multi-hull craft such as trimarans are inherently longitudinally stable, and when steered by a rudder they tend to suffer (like all directionally stable vehicles) from the phenomenum known as under-steer. That is to say, they do not readily "answer the helm".

Attempts have been made to diminish this effect by dispensing with the use of a rudder by the substitution of such expedients as turning the hulls relatively to each other in a horizontal plane. However, these arrangements have suffered from various disadvantages. For example, if the outer hulls are connected together (by spars or the like) and turned with respect to the middle hull, too much drag occurs. If however, the only practical known system is used, namely, that wherein the middle hull is turned with respect to the outer hulls, the mere size of the middle hull is such that the inertia of the system causes under-steer as before.

According to the invention therefore the above and other disadvantages are overcome by a multi-hull craft which comprises, in combination, a plurality of hulls each constructed from flexible envelopes inflated pneumatically to obtain buoyancy, and wherein the middle or steering hull is pivotally mounted for controlled angular variation in azimuth, and is located ahead of the outer hulls to at least an extent sufficient to permit the stern of the front hull to clear the bows of the outer hulls during such angular variation whereby the craft is steered.

Figure 1:
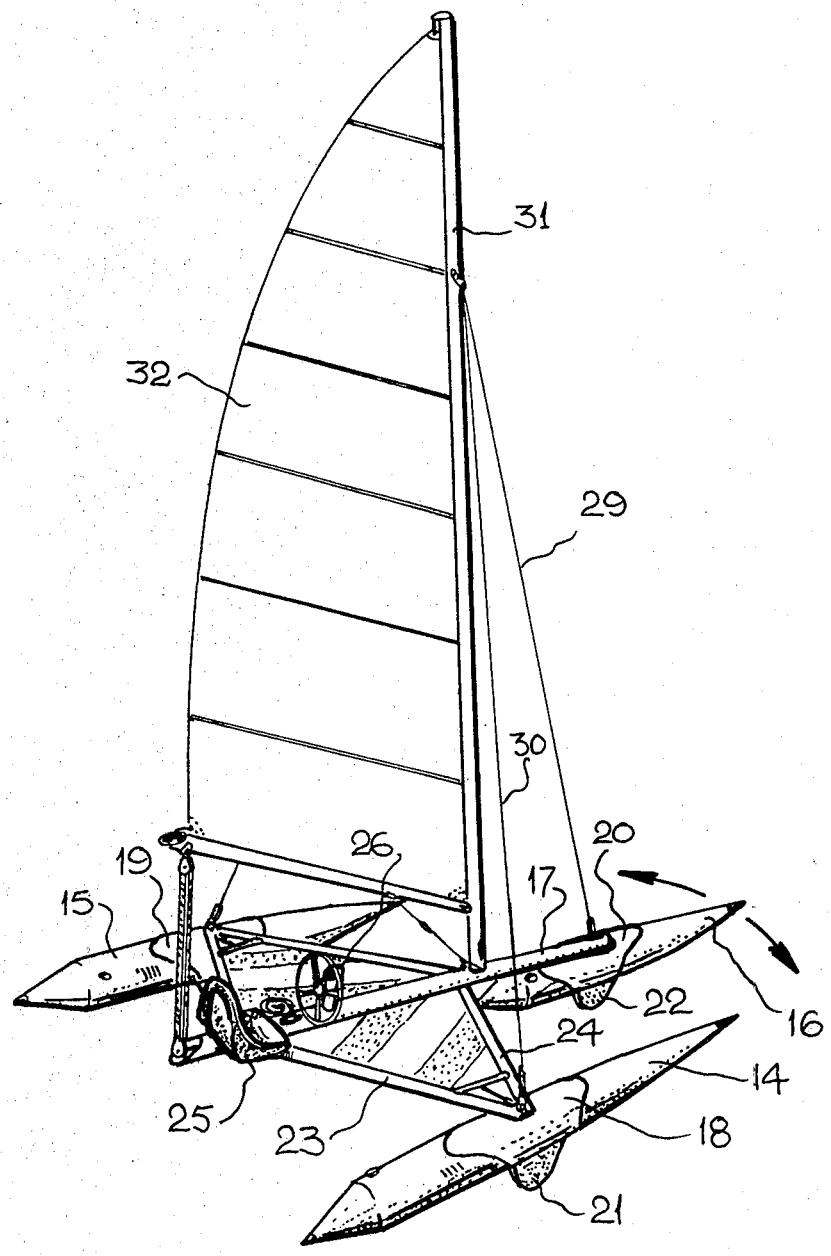
Figure 4:
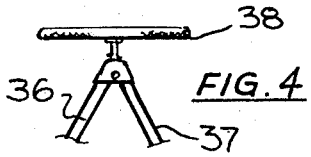
Figure 2:
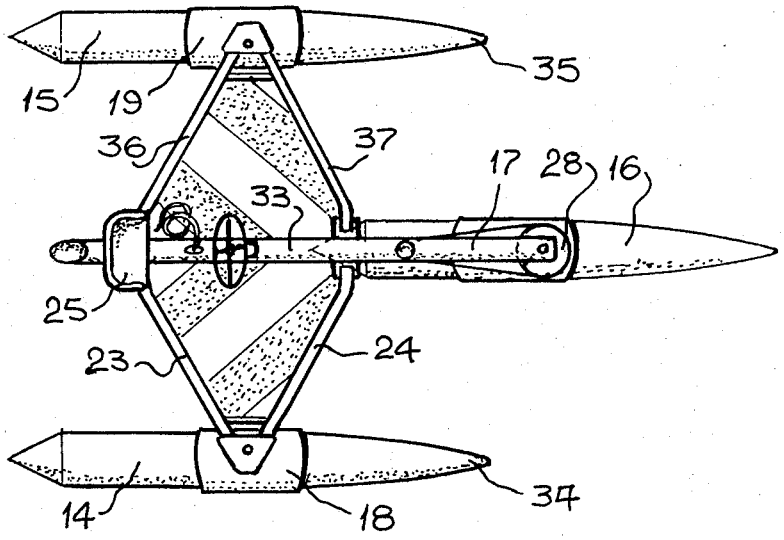
Figure 3:
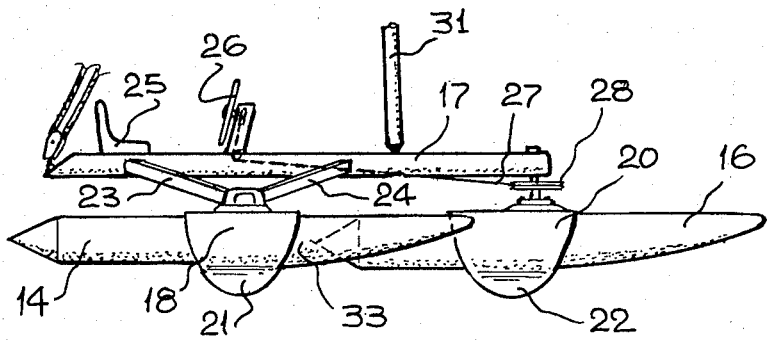
Figure 5:
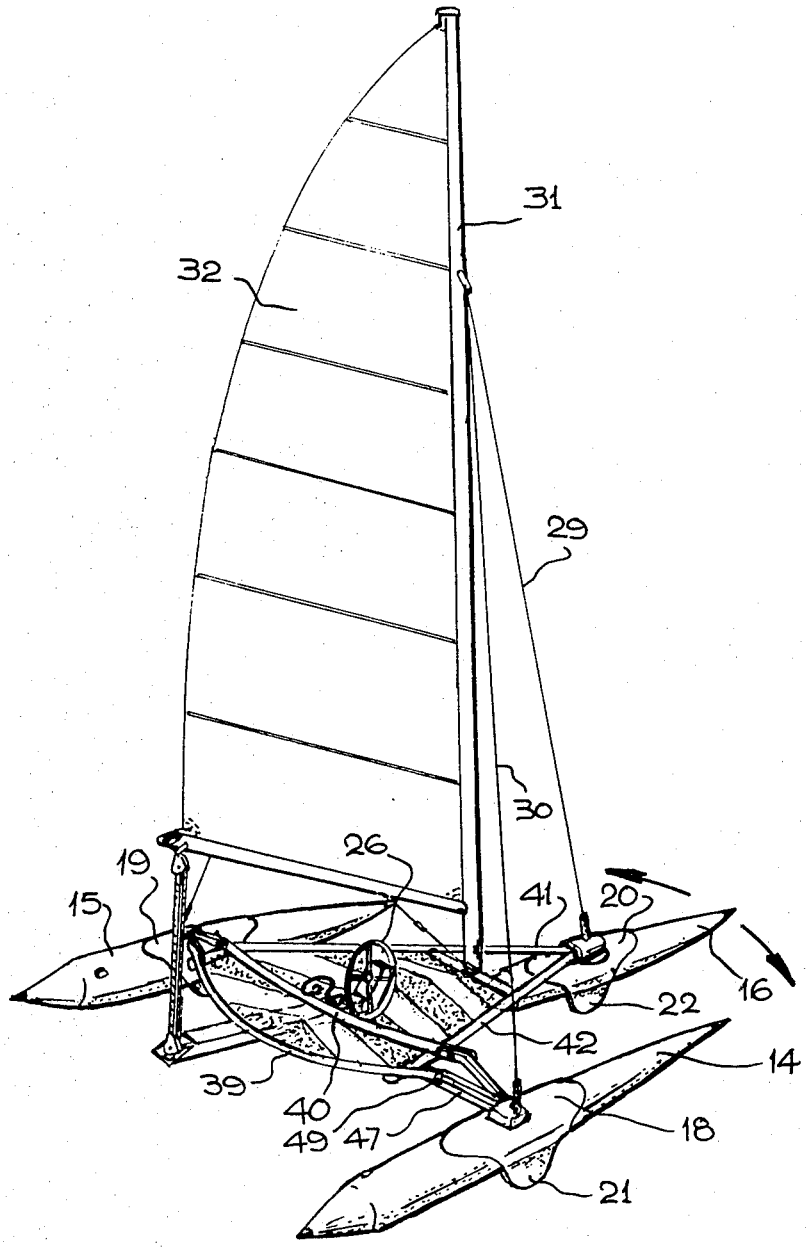
Figure 8:
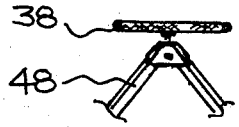
Figure 6:
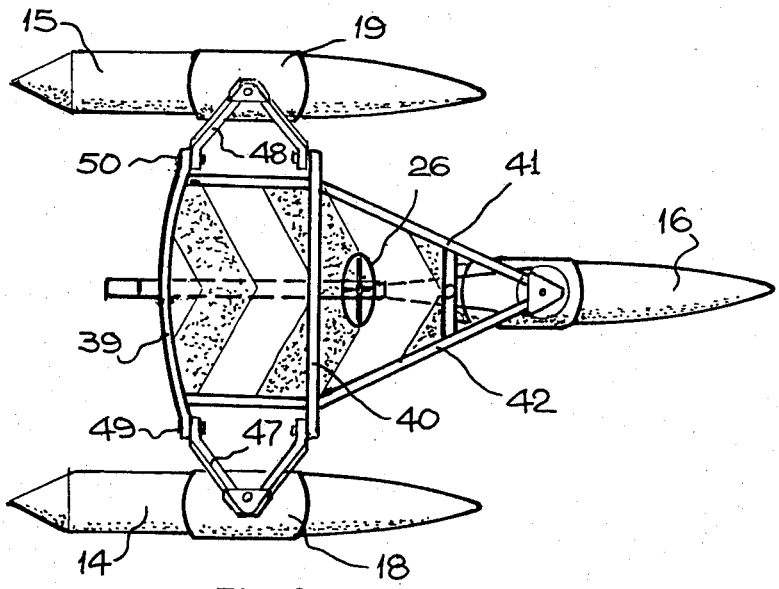
Figure 7:
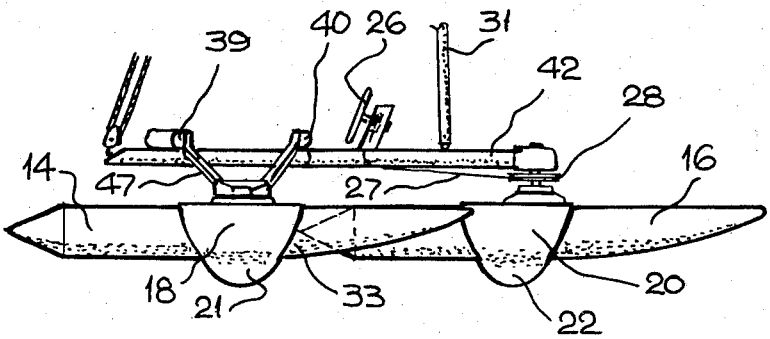
Figure 9:
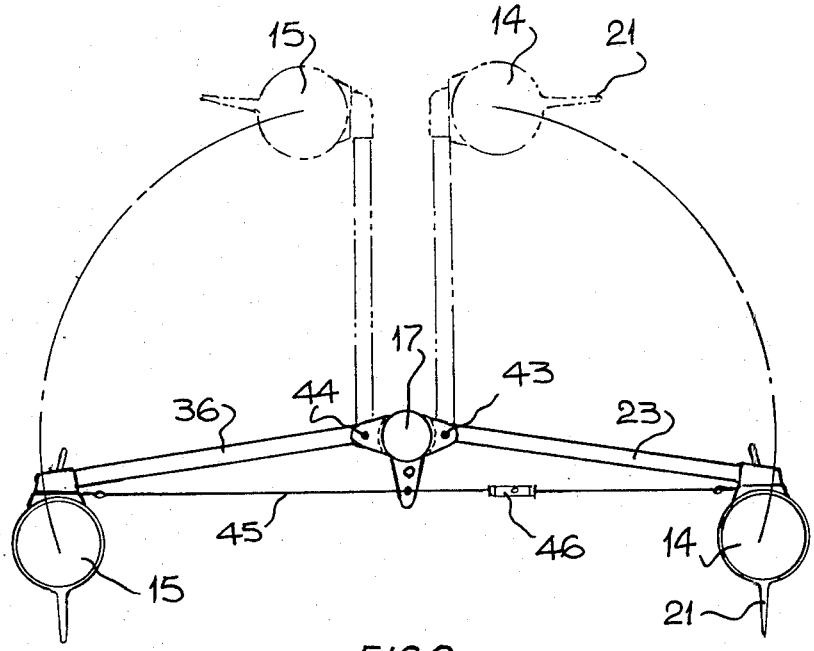
Figure 10:
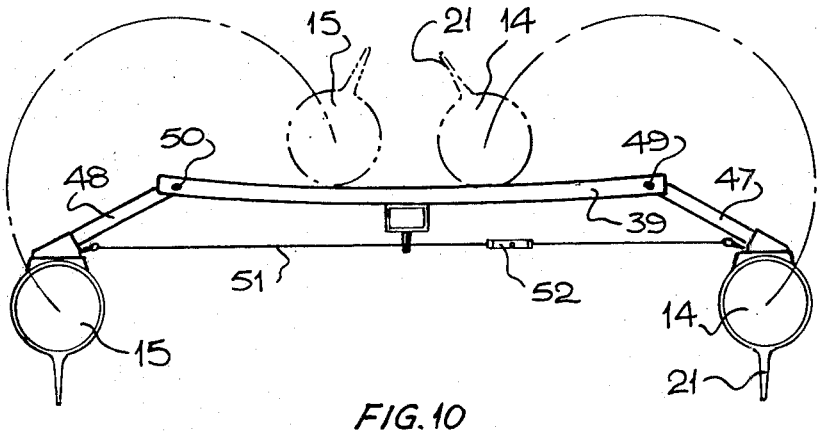
Figure 11:
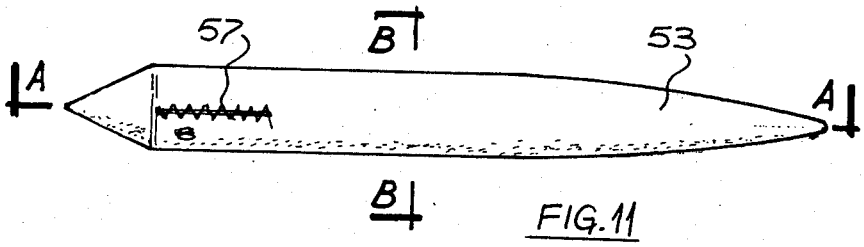
Figure 12:
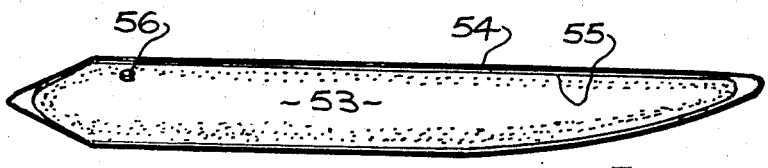
Figure 13:
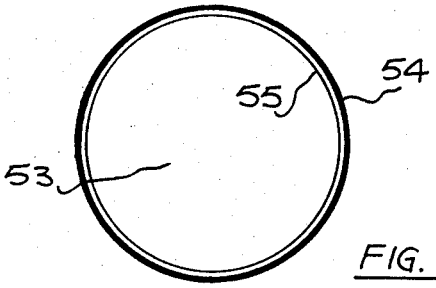
Figure 14:
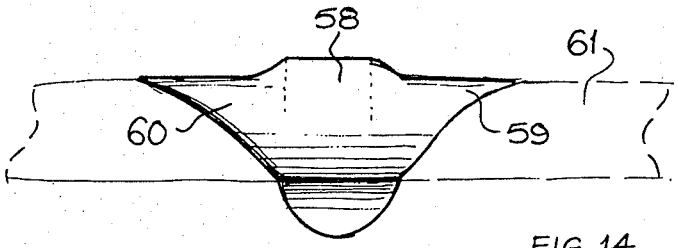
Figure 15:
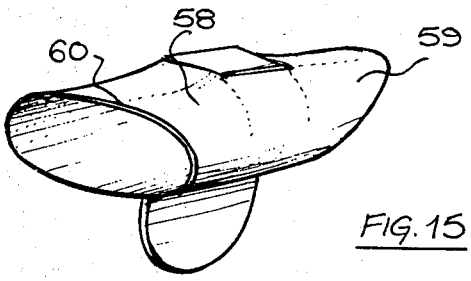
Figure 16:
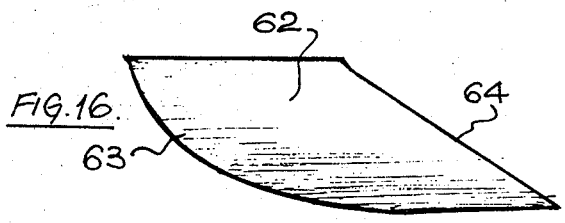
Figure 17:
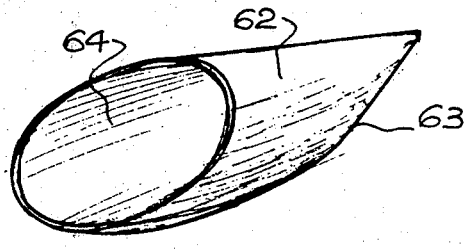
Figure 18:
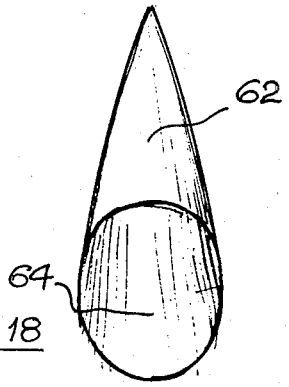

Certain embodiments of the invention defined in the preceding paragraph will now be described herein with reference to the accompanying drawings, in which similar references indicate corresponding parts, and in which:

FIG. 1 shows, in perspective view, a trimaran constructed in accordance with a first embodiment of the invention, FIG. 2 shows, in plan view, the apparatus of FIG. 1, FIG. 3 shows, in side elevation, a portion of the apparatus of FIGS. 1 and 2, FIG. 4 shows, in plan view, a road wheel adapted to replace a float in a land-based modification of the apparatus of FIGS. 1 to 3, FIG. 5 shows, in perspective view, a second embodiment of the invention, FIG. 6 shows, in plan view, the apparatus of FIG. 5, FIG. 7 shows, in side elevation, a portion of the apparatus of FIGS. 5 and 6, FIG. 8 shows, in plan view, a road wheel adapted to replace a float in a land-based modification of the apparatus of FIGS. 5, 6 and 7, FIG. 9 shows, in end elevation, means for folding the apparatus of FIGS. 1 to 4 for stowing and/or transport purposes, FIG. 10 shows, in end elevation, means for folding the apparatus of FIGS. 5 to 8 for stowing and/or transport purposes, FIG. 11 shows, in side elevation, a modified form of float having an inner pneumatic tube, FIG. 12 shows, in side elevation, a section along the line A—A of FIG. 11, FIG. 13 shows, in end elevation, a section along the line B—B of FIG. 11, FIG. 14 shows, in side elevation, a modified form of mounting trunnion for a float, FIG. 15 shows, in perspective view, the trunnion of FIG. 14, FIG. 16 shows, in side elevation, a stiffening ferrule for a float, FIG. 17 shows, in perspective view, the apparatus of FIG. 16, and FIG. 18 shows, in plan view, the apparatus of FIGS. 16 and 17.

Upon referring to the drawings it will be seen that in said first embodiment of the invention a trimaran comprises two fixed outboard hulls 14 and 15, and a steerable hull 16 which is mounted with respect to the longitudinal member 17. Each said hull is hollow and derives its buoyancy from the pneumatic inflation of relatively thin outer envelopes which may be formed from the durable material normally used for the construction of inflated life rafts or the like, and the resulting "floats" may be sufficiently light to enable the entire craft to be lifted by one person.

Each said float is attached via one of the respective mounting trunnions 18, 19 and 20, from each of which a respective fin such as 21 and 22 depends in known manner. The trunnions are in turn connected to the framework of a yacht. For example, the trunnion 18 is connected to the spars 23 and 24, whereas the trunnion 20 is connected to the member 17 upon which a helmsman's seat 25 is mounted in a position wherein the wheel 26 may be employed to steer the craft. For this purpose the steering system linkage may comprise a sheet or cable 27 which engages the pulley wheel 28 and is formed from material similar to that used for the guys 29 and 30, which in turn support the mast 31 and hence the sail 32 in known manner. The spars such as 23 and 24 may be formed from light alloy corrosion-resistant metal tubes.

It will be seen that the forward central float 16 is so disposed with respect to the outboard floats 14 and 15 that any manipulation of the wheel 6 to turn the pulley wheel 28, and hence the float 16, causes the latter to turn to a desired degree whilst still keeping the after end 33 clear of the respective forward ends 34 and 35 of the floats 14 and 15 whilst describing its arcuate path. Furthermore, the pronounced forward placement of the hull 16 with respect to the hulls 14 and 15 renders the resultant steering action very sensitive. Consequently, only a slight turning of the hull 16 is required to effect substantial changes in the craft's direction, and hence the amount of drag caused by the partial lateral attitude of the hull 16 is minimal in comparison with prior known systems wherein the outboard hulls were turned for steering purposes.

The floats may be demounted from the main framework of the craft, for example, by slackening off the fastening means which attaches the trunnion 19 to the spars 36 and 37, in which case suitable roadwheels such as 38 may be substituted for said floats to convert the craft to a land yacht, the motion of which across solid ground such as pavement or hard-packed sand is equivalent to its motion under sail in water when mounted upon said floats. The roadwheel 38 is preferably a lightweight structure in the nature of an aircraft undercarriage wheel or a bicycle wheel or the like, having a pneumatic tire mounted upon a rim.

In the embodiment of the invention shown in FIGS. 5 to 8 inclusive the spars 23, 24, 36 and 37 are replaced by spars 39 and 40, and the member 17 is replaced by spars 41 and 42 which provide an equivalent structural frame for the craft and dispense with the need for the helmsman's seat 25. Again, the wheel 26 may steer the float 16 via pulley wheel 28 and cable 27. Also, the roadwheels such as 38 may be substituted for the relevant floats as described with reference to the first embodiment.

As best shown in FIG. 9, the spars 23 and 36 of the first-mentioned embodiment of the invention, and also their associated spars 24 and 37, may be elevated by rotating them about the respective hinges 43 and 44 into a stowed format wherein the spars are substantially vertical, thereby rendering the structure more suitable for storage and/or transport, in which case of course the mast 31 may be un-stepped after furling the sail 32 in known manner. In this arrangement, the floats 14 and 15 may be retained firmly in their working positions by coupling means comprising a cable such as 45, controlled by a suitable turnbuckle or similar fastening 36. This last-mentioned arrangement also permits the "track" of the floats 14 and 15 to be varied so as to alter the speed and stability characteristics of the craft.

In a modification of the apparatus of FIG. 9, shown in FIG. 10, similar provisions are made for stowing and/or transport by rotating the spars 47 and 48 about respective pivots 49 and 50 so as to mount the floats 14 and 15 above and upon the spar 39 as shown. Here again, a suitable coupling means comprising a cable 15, tightened and held in position by a turnbuckle 52 or the like, may restrain the floats in their working positions, and may also permit an alteration of track for the craft by immobilising said floats after determining a suitable angle of the spars 47 and 48 about their respective pivots 49 and 50.

In a further modification of the invention shown in FIG. 11, the unitary floats such as 14, 15 and 16 may each be replaced by a composite float such as 53 which possesses an outer protective durable layer or skin 54 and an inner tube 55, akin to the inner tube of a vehicle tire, and capable of inflation via a suitable valve such as 56. A gusset 57 may be provided in the casing 53 and may be laced or otherwise closed by removable fastenings in known manner after the deflated tube 55 has been inserted within said casing and then inflated.

In a still further modification of the invention shown in FIG. 14, a preferred form of trunnion 58 has extensions 59 and 60 of its upper surface to support, with a reactive force, any upward bending forces upon the "beam" constituted by a float such as 61.

In yet another modification of the invention shown in FIG. 16, a stiffening ferrule 62, having a closed leading end 63 and an open rearward mouth 64, is adapted to fit upon the leading ends of each of said hulls 14, 15 and 16 either externally or, in the case of the modification shown in FIGS. 11 to 13, internally upon the tube 55. Whether applied externally upon the outer envelope or internally upon the tube, said ferrules may be retained in position frictionally, or may be fastened by suitable adhesives or other attachment means, and should be formed from rigid material which is sufficiently tough or impact-resistant to maintain a sharp angle of attack for each said hull, especially at low speeds.

Thus, a craft constructed in accordance with the invention, in any one of its embodiments, possesses not only a very responsive steering system which dispenses with the need for a rudder and requires no extraneous power assistance, but is capable of a simple adjustment of its track by a suitable manipulation of a spider-like mechanism comprising said spars and couplings means, said adjustments being possible even without the use of tools. Said track adjustment permits a quick alteration of the character of the craft, which may thus readily exchange the advantages of cruising stability and racing speed to effect a suitable compromise within its existing design limits.

The last-mentioned feature, namely track adjustment, is of somewhat more significance in a sail boat but the fist-mentioned feature, namely the quick steering (neutral response or "over-steer") is of significance for either power or sail propulsion systems.

An overall advantage results however from the lightness and demountability of the craft, which is thus easy to slip, carry, stow or prepare for launching. Furthermore, the craft may be amphibious and is readily convertible from water to land use, since it is a simple matter to employ mountings for said floats of a kind easily adaptable to known wheel systems for land yachts.

The claims defining the invention are as follows:

1. A multi-hull craft steering system comprising:

a frame member;

a plurality of hulls each constructed from flexible envelopes pneumatically inflated to obtain buoyancy, said hulls being supported by a trunion mounted to said frame member, each of said trunions having a hollow body enveloping one of said flexible envelopes near a mid-region of said envelopes, the upper surface of each of said hollow bodies extending longitudinally to a greater extent than the remainder of said bodies, wherein one of said hulls is a middle steering hull pivotally mounted for controlled angular variation in azimuth, said middle hull located ahead of the remaining hulls to at least an extent sufficient to permit rotation of said middle hull to avoid interference with the bows of the remaining hulls during such angular variation whereby said craft is steered;

said outer hulls having a variable track therebetween, whereby said hulls are selectivley locatable in a discrete number of locations;

a locking means for maintaining said hulls at one of said locations; and means for angularly rotating the outer hulls away from the longitudinal axis of said craft about a hinge means connected to said frame from a first working position to a second stowed position, said stowed position permitting transportation and storage of said craft.

2. A multi-hull craft steering system as claimed in any one of claim 1, wherein each said hull comprises a unitary hollow envelope.

3. A multi-hull craft steering system as claimed in any one of claim 1, wherein each said hull cmprises an outer protective casing enclosing therein an inner inflatable tube.

4. A multi-hull craft steering system as claimed in any one of claim 1, wherein each said hull has a stiffening ferrule, formed from rigid material, applied fittingly to the leading end thereof.

5. A multi-hull craft steering system as claimed in any one of claim 1, wherein each said hull is adapted to be repalced by a road wheel temporarily lockable with respect to said frame to thereby convert said craft to a land yacht.

6. A mult-hull craft as claimed in claim 1, having three of said hulls, to thereby constitute a trimaran.

* * * * *